United States Patent [19]
Lohrberg

[11] Patent Number: 4,474,612
[45] Date of Patent: Oct. 2, 1984

[54] VERTICALLY EXTENDING PLATE ELECTRODE FOR GAS-FORMING ELECTROLYZERS

[75] Inventor: Karl Lohrberg, Heusenstamm, Fed. Rep. of Germany

[73] Assignee: Metallgesellschaft Aktiengesellschaft, Frankfurt am Main, Fed. Rep. of Germany

[21] Appl. No.: 520,068

[22] Filed: Aug. 3, 1983

[30] Foreign Application Priority Data

Aug. 3, 1982 [DE] Fed. Rep. of Germany ..... 3228884

[51] Int. Cl.³ ..... C25B 9/00; C25B 11/03
[52] U.S. Cl. ..... 204/252; 204/283; 204/284
[58] Field of Search ..... 204/283, 284, 252

[56] References Cited

U.S. PATENT DOCUMENTS

| | | | |
|---|---|---|---|
| 1,771,091 | 7/1920 | Lawaczeck | 204/101 |
| 4,142,950 | 3/1979 | Creamer | 204/284 |
| 4,252,628 | 2/1981 | Boulton | 204/290 R |

FOREIGN PATENT DOCUMENTS

| | | |
|---|---|---|
| 453750 | 12/1927 | Fed. Rep. of Germany . |
| 2059868 | 7/1974 | Fed. Rep. of Germany . |
| 1028153 | 5/1953 | France . |

*Primary Examiner*—John F. Niebling
*Attorney, Agent, or Firm*—Karl F. Ross; Herbert Dubno

[57] ABSTRACT

In gas-forming electrolyzers, particularly membrane electrolyzers having vertically extending plate electrodes, each electrode plate is divided into horizontal strips and the entire active electrode surface is parallel to the counterelectrode and spaced from it as closely as possible. The top portions of each of the horizontal strips into which the electrode is divided define gas escape paths and extend away from the counterelectrode. To improve the degassing of the electrolyte the ratio of the distance G between the counterelectrode or membrane and the gas-defining line S at the lower edge of each electrode strip to the distance E between the counterelectrode or membrane and the breakaway edge K of the angled portion defining the gas escape path corresponds to a degassing capability F which is lower than 0.6.

11 Claims, 3 Drawing Figures

VERTICALLY EXTENDING PLATE ELECTRODE FOR GAS-FORMING ELECTROLYZERS

CROSS REFERENCE TO RELATED APPLICATION

This application is related to the commonly assigned copending application Ser. No. 507,840 filed June 24, 1983.

FIELD OF THE INVENTION

This invention relates to a vertically extending plate electrode for gas-forming electrolyzers, which plate is horizontally divided into electrode strips by slits (separations); the top portion of each strip extends away from the counterelectrode to define the gas escape paths formed by the slits.

More particularly, the invention relates to the relationship between an electrode formed with slit-like openings extending horizontally for the escape of gases, which may be juxtaposed with a planar member, generally a membrane as described in the above-identified copending application, or a counter-electrode, in a gas-producing electrolysis cell.

BACKGROUND OF THE INVENTION

In electrochemical processes it is essential to ensure a uniform distribution of the current over the electrode surface. That uniform distribution is influenced by the throwing power of the electrolyte and by the homogeneity of the electrodes. The throwing power will increase with the surface area on which the current flow lines are incident on the counterelectrode. While an inadequate throwing power can be compensated by an increase of the interelectrode distance, this will increase the voltage drop across the cell.

If inhomogeneities are present in the surface of the electrode, the flow of current will result in local distortions. For this reason the interelectrode distance i.e., the distance between the anode and the cathode, is of great importance. In membrane electrolytic cells having a membrane and producing gases, such as chlorine, oxygen, hydrogen, it is difficult to maintain or adjust a small interelectrode distance and the gas bubbles cannot escape as quickly as is required if the interelectrode distance is small.

Any gas present in the electrolyte between the electrode will reduce the electrical conductivity of the electrolyte so that the power consumption will be increased. In addition, microscopic distortions of the surface of the electrode may be caused by the electric current. The evolution of gas also gives rise to turbulence in the electrolyte. A turbulent motion of the electrolyte has the disadvantage that the membrane is subjected to intense mechanical stress. In order to avoid an accelerated destruction of the membrane it is generally necessary to restrict the height of the electrodes, to select a considerable distance between the electrodes of the cell, and to limit the electric current density although this will adversely affect the energy efficiency of the electrolytic cell and its productivity.

To reduce the disadvantages of electrolytic cells having membranes and vertically extending electrodes it is usual to employ electrodes having openings for the escape of the reaction gases. Such electrodes may consist of perforated electrodes, wire mesh or expanded metal. The disadvantages reside, inter alia, in a smaller active surface area, inadequate stability and loss of high-grade coating material on the rear of the electrode.

It has been proposed in German Patent document No. 2,059,868 to provide in gas-forming diaphragm cells having vertically extending electrodes, a plate electrode which consists of several plates having surfaces for guiding the escaping gas which has been formed.

The inclination of the guiding plate inevitably resulted in different distances from the active surface to the counter electrode. French Pat. No. 1,028,153 discloses an electrolyzer in which the electrodes are parallel and have the smallest possible spacing. The known electrodes consist of one or more strips which define horizontal openings formed by an angled portions of the strips and opposing the escape of gas with the smallest possible resistance. The angled portions extend away from the counter-electrode so that the active surface area is not appreciably reduced. A similar electrode arrangement is known from German Pat. No. 453,750. These electrodes are formed with cuts, which permit portions of any desired configuration to be bent out so that they extend away from the counterelectrode.

While such electrodes, particularly cathodes, have been known for more than 30 years, they have not been commercially exploited, but perforated sheet metal, expanded metal or similar materials are still employed.

OBJECT OF THE INVENTION

It is an object of the invention to provide an electrode which can be used with a minimum spacing ratio and yet ensures a reliable and rapid escape of gas from the electrolyte.

SUMMARY OF THE INVENTION

This object is accomplished according to the invention in a vertically extending plate electrode for gas-forming electrolyzers, particularly membrane electrolyzers, comprising horizontal strips having an active electrode surface, which strips throughout their active electrode surface are parallel to the counterelectrode and have the smallest possible distance therefrom whereas the top portion of each of the strips extends away from the counter-electrode and defines a gas escape path.

In an electrode assembly of this kind the invention resides in that the ratio of the distance G between the counter-electrode or membrane and the gas-dividing line 5 at the lower edge of each electrode strip to the distance E between the counterelectrode or membrane and the breakaway edge K of the angled portion defining the gas escape path corresponds to a value F (degassing capability) below 0.6.

It has been found that the above-mentioned ratio results in a degassing of the electrolyte-gas suspension to a particularly desirable degree and in an expansion of the gas which is released and ensures that a major portion of the gas will flow behind the next upper electrode strip so that the electrolysis at said upper electrode strip will not be adversely affected or will not be adversely affected to an appreciable degree.

When reference is made herein to the distance between the counterelectrode and the gas-defining line or the distance between the counterelectrode and the break-away edge, it will be understood that these distances are measured horizontally and perpendicular to the plane of the counterelectrode which is generally disposed vertically. The gas-defining line is the line at which gas passing upwardly is determined to pass between the plane of the electrode provided with the passages and the plane from which the distance is measured as described previously Gas to the other side of this line is generally directed behind the electrode.

It is, therefore, of interest to describe the electrode as having a front and a back. The front surface of the electrode is that surface which is most closely juxtaposed with the counter-electrode. When the horizontal slits defining the gas passages are delimited by a chamfer, the upper edge of this chamfer is inclined downwardly and forwardly, the break-away line is the line at which the plane of the chamfer meets the plane of the front of the electrode. If there is no chamfer or if there is a chamfer in the opposite direction, i.e. the chamfer is downwardly and rearwardly, the break-away line can be the rearmost edge of the upper board of the slit.

Of course, when a membrane is utilized, the horizontal distances measured from the gas-defining line and the break-away edge will be measured to the plane of the member which is proximal to the electrode formed with the passages. Thus, this membrane and the counterelectrode can be considered planar members juxtaposed with the passage-forming electrode and the distance in question is measured to the most proximal surface of the member which is most directly juxtaposed with the electrode.

The angled portion of each strip of the electrode according to the invention generally consists of a flat surface, but may also be curved. The angle included by the angled portion and the electrode plane generally amounts to between 15° and 70°. Each plate may have a height of 5 to 50 centimeters and a thickness of about 1 to 3 millimeters. The slit width can be 1 to 10 times this thickness. The thickness of each electrode strip will be selected in view of the width of the electrode because no additional current distributing pins are provided, which are required, e.g., in cells which have conventional dimensions and in which expanded metal is used to form the active surface.

The electrode plates are fixedly installed in known manner in a frame which has terminals for the supply of electric current.

The electrode according to the invention may be used as an anode or cathode in electrolytic processes using a membrane. When used as an anode, the electrode can consist of titanium, tantalum, tungsten or zirconium. In that case the electrode is provided with an activating coating only on its surface facing the counterelectrode. That activating coating may consist in known manner, of metal oxides or of metals of the group platinum, iridium, osmium, palladium, rhodium, ruthenium. If the electrode according to the invention is used as a cathode in electrolytic processes using a membrane, the electrode may consist, e.g. of steel or nickel or alloys thereof.

The electrode plate according to the invention can be installed in electrolyzers having membranes. In connection with the invention, the term "membrane cells" is used to describe only cells which have ion-selective membranes, such as perfluorinated cation exchanger membranes. Such membranes can be used to separate cathodic and anodic products of an electrolysis from each other or from the reactants supplied to the respective counterelectrode.

BRIEF DESCRIPTION OF THE DRAWING

The above and other objects, features and advantages of the present invention will be more readily apparent from the following description, reference being made to the accompanying drawing in which.

SPECIFIC DESCRIPTION

Figure 1:
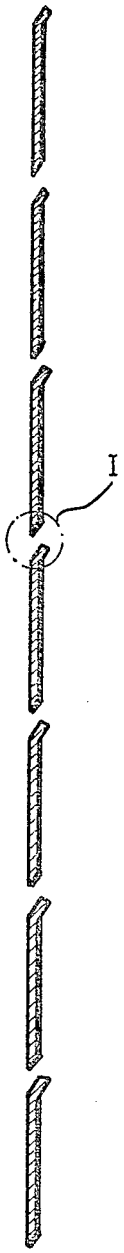
FIG. 1 is a vertical section through a plate electrode according to the invention.
Figure 2:
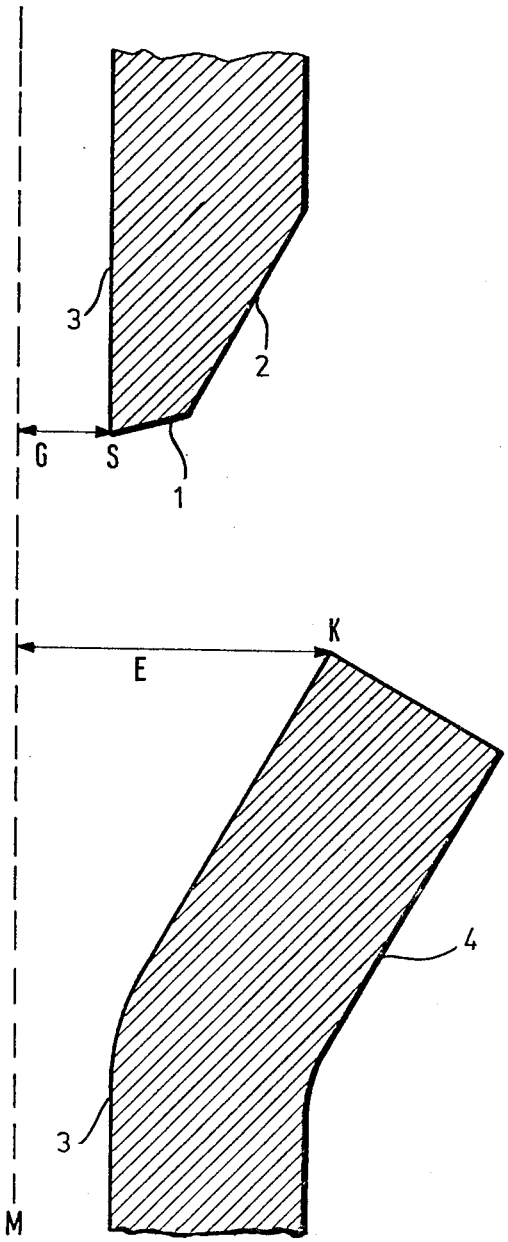
FIG. 2 is a detail view of the region II of FIG. 1.

The electrode arrangement according to the invention is shown by way of example in FIGS. 1 and 2 of the drawing. FIG. 1 is a side elevation showing an electrode which is horizontally divided into individual strips having angled portions which define gas escape paths. (The electrode frame and current supply terminals are not shown.)

FIG. 2 shows the detail which is designated "A" in FIG. 1. In FIG. 2, M designates the membrane, 5 the gas-dividing line at the lower end of the plate strip, K the breakaway edge of the angled top portion of the next lower strip, G the distance M–S and E the distance M–K.

In the chamfered electrode shown in FIG. 2, the gas-dividing lines extends in the plane of the active surface 3 at the lower edge of the downwardly and forwardly extending chamfer, which in term lies forwardly of the downwardly and forwardly inclined level 2. In electrodes which are not chamfered it is assumed that the gas-dividing line lies on the center plane of the electrode. The term "degassing capability" is used in consideration of the fact that the gas rising from the interelectrode gap will expand as far as to the breakway edge K and will then rise vertically and will be divided at the gas-dividing line into a portion which enters the interelectrode gap and a larger, second portion which in accordance with the invention flows behind the electrode.

In a commercial plant for the production of sodium chloride solution by an electrolysis of alkali chloride, which plant comprised ion-selective membranes, a sodium chloride solution having a concentration of 320 grams per liter was electrolyzed. The current density amounted to 3.1 $kA/m^2$ and the temperature of the electrolyte amounted to 80° C.

The cathodes consisted of electrodes according to the invention in which the individual plate strips had a height of 14 centimeters and the active surfaces amounted to about 90% of the projected area. The material consisted of St 37 steel having no activation. A comparison was made with conventional cathodes consisting of the same material in the form of expanded metal and having the same active surface area relative to the projected area. The counterelectrodes consisted of dimensionally stable anodes. The selective membranes consisted of pefluorinated ion exchanger membranes (trade name Nafion). Each plate had a thickness of 6.5 mm and a width of 100 centimeters. The angled portion 4 which defined the gas escape path included (as shown) an angle of 30° with the surface 3. The width of the gap between adjacent plate strips amounted to 20 mm. The distance between the surfaces of the cathode and membrane amounted to 3 mm. The total electrode surface amounted to $1 \times 1$ $m^2$.

The following voltage drops were measured:

| | |
|---|---|
| Expanded metal cathode | 3.50 volts |
| Strip cathode I according to the invention | 3.40 volts |
| Strip cathode II according to the invention | 3.65 volts |

If the distance M–S (see FIG. 2) is designated G and the distance M–K is designated E (expansion space), the degassing capability (expansion capability) F (%) equal to the ratio of G to E will be as follows

| | G:E | F (%) |
|---|---|---|
| With strip cathode I | 0.45 | 55 |
| With strip cathode II | 0.60 | 40 |

Figure 3:
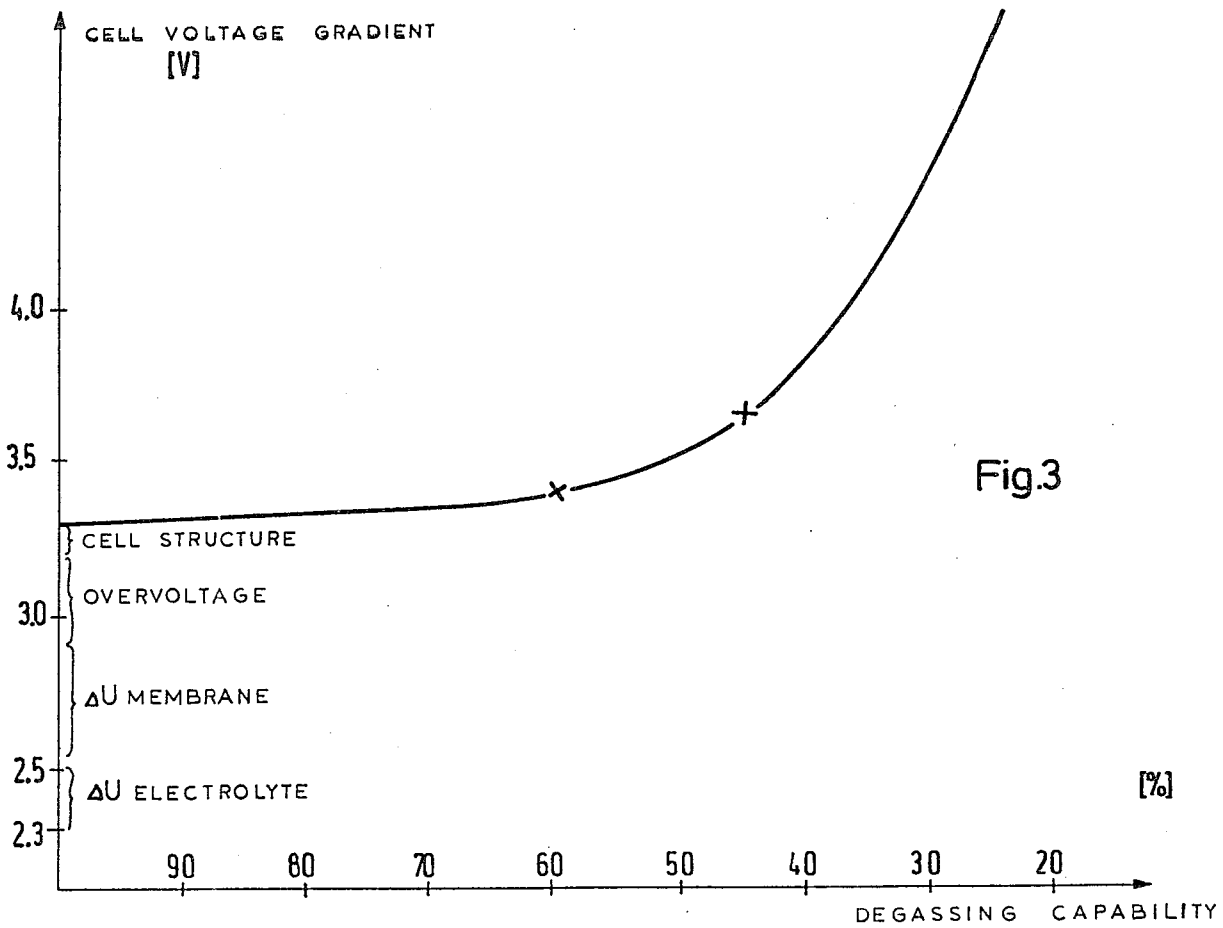
FIG. 3 is a graph illustrating the invention.

If a curve is plotted with calculated values for a degassing capability of 100% and a degassing capability of 0%, the measured points will lie on the curve of the graph shown in FIG. 3, in which the voltage drop has been plotted against the degassing capability.

The advantages afforded by the electrode plate according to the invention reside in that the electrode plate may be spaced from the counterelectrode as closely as possible and may be completely activated on its surface which is parallel to the counterelectrode and a local overheating of the temperature-sensitive membrane will be avoided. The gas evolved between the anode and the cathode is permitted to escape quickly from the region behind the active surface to the region behind the electrode. The electrodes can be made from flat sheet metal in a simple manner and with a low expenditure. An active surface layer may be applied to one side without difficulty.

I claim:

1. In a gas-generating electrolysis cell having a vertically oriented passage-forming electrode juxtaposed with a planar member participating with the electrode in a gas-generating electrolysis action and wherein said passages are horizontal slit-like gaps formed in said electrode, the improvement wherein in combination:

each of said gaps is defined by an upper boundary and said electrode has a forward planar surface juxtaposed with and parallel to said member;

a lower limb of each of said gaps is defined by a rearwardly extending portion having a break-away edge at the top thereof located rearwardly of said surface, said rearwardly extending portion having a width less than that of said surface in vertical direction, said upper boundary being defined by a downwardly and forwardly extending bevel terminating forwardly of said break-away edge and having a gas-dividing line separating gas rising forwardly of said surface from gas deflected rearwardly of said electrode; and the ratio between the horizontal distance G between said gas-dividing line and said member and the horizontal distance E between said break-away edge and said member is less than 0.6.

2. The improvement defined in claim 1 wherein said bevel terminates at a downwardly and forwardly extending chamfer forming said gas-dividing line at said surface.

3. The improvement defined in claim 2 wherein said portion includes an angle between substantially 15° and 70° with said surface.

4. The improvement defined in claim 3 wherein said angle is substantially 30°.

5. The improvement defined in claim 4 wherein said electrode is a plate of a thickness of substantially 1 to 3 mm.

6. In a gas-generating electrolysis cell having a vertical oriented passage-forming electrode juxtaposed with a planar member participating with the electrode in a gas-generating electrolysis action and wherein said passages are horizontal slit-like gaps formed in said electrode, the improvement wherein in combination:

each of said gaps is defined by an upper boundary and said electrode is a plate of a thickness of substantially 1 to 3 mm and has a forward planar surface juxtaposed with and parallel to said member;

a lower limb of each of said gaps is defined by a rearwardly extending portion including an angle of about 30° with said surface and having a break-away edge at the top thereof located rearwardly of said surface, said rearwardly extending portion having a width less than that of said surface in vertical direction, said upper boundary being defined by a downwardly and forwardly extending bevel terminating forwardly of said break-away edge and having a gas-dividing line separating gas rising forwardly of said surface from gas deflected rearwardly of said electrode said bevel terminating at a downwardly and forwardly extending chamfer forming said gas-dividing line at said surface; and the ratio between the horizontal distance G between said gas-dividing line and said member and the horizontal distance E between said break-away edge and said member is less than 0.6, said gaps having widths of substantially one to ten times the thickness of said plate.

7. In a gas-generating electrolysis cell having a vertical oriented passage-forming electrode juxtaposed with a planar member participating with the electrode in a gas-generating electrolysis action and wherein said passages are horizontal slit-like gaps formed in said electrode, the improvement wherein in combination:

each of said gaps is defined by an upper boundary and said electrode is a plate of a thickness of substantially 1 to 3 mm and has a forward planar surface juxtaposed with and parallel to said member;

a lower limb of each of said gaps is defined by a rearwardly extending portion including an angle of about 30° with said surface and having a break-away edge at the top thereof located rearwardly of said surface, said rearwardly extending portion having a width less than that of said surface in vertical direction, said upper boundary being defined by a downwardly and forwardly extending bevel terminating forwardly of said break-away edge and having a gas-dividing line separating gas rising forwardly of said surface from gas deflected rearwardly of said electrode said bevel terminating at a downwardly and forwardly extending chamfer forming said gas-dividing line at said surface; and the ratio between the horizontal distance G between said gas-dividing line and said member and the horizontal distance E between said break-away edge and said member is less than 0.6, said plate having a height of 5 to 50 cm.

8. The improvement defined in claim 7 wherein said plate consists of titanium, tantalum, tungsten or zirconium and is provided with a coating of a metal oxide or a metal selected from the group which consists of platinum, iridium, osmium, palladium, rhodium and ruthenium.

9. The improvement defined in claim 7 wherein said electrode consists of steel, nickel or an alloy thereof.

10. In a vertically extending plate electrode for gas-forming electrolyzers, particularly membrane electrolyzers, comprising electrode plates which are divided into horizontal strips having an active electrode surface, which strips throughout their active electrode surface are parallel to a counterelectrode and have the smallest possible distance therefrom whereas the top portion of each of said strips extends away from the counterelectrode and defines a gas escape path, the improvement wherein the ratio of the distance G between the counterelectrode or membrane and a gas-dividing line S at a lower edge of each electrode strip to the distance E between the counterelectrode or membrane and a breakaway edge K of an angled portion defining gas escape path corresponds to a value F of the gassing capability below 0.6.

11. In an assembly for use in gas-forming electrolyzers, particularly membrane electrolyzers, comprising a vertically extending plate electrode, a counterelectrode and a membrane between the plate electrode and the counterelectrode, wherein the plate electrode is divided into horizontal strips having an active electrode surface facing the counterelectrode, said strips being parallel to said counterelectrode and having the smallest possible distance therefrom throughout their active surface area and each of said strips having a top portion which extends away from the counterelectrode and defines a gas escape path, the improvement in that the ratio of the distance G between the counterelectrode or membrane and a gas-dividing line S at the lower edge of each electrode strip to the distance E between the counterelectrode or membrane and a breakaway edge K of an angled portion defining the gas escape path corresponds to a value F of the degassing capability below 0.6.

* * * * *

REEXAMINATION CERTIFICATE (982nd)

United States Patent [19]

[11] B1 4,474,612

Lohrberg

[45] Certificate Issued Jan. 3, 1989

[54] VERTICALLY EXTENDING PLATE ELECTRODE FOR GAS-FORMING ELECTROLYZERS

[75] Inventor: Karl Lohrberg, Heusenstamm, Fed. Rep. of Germany

[73] Assignee: Metallgesellschaft Aktiengesellschaft, Frankfurt am Main, Fed. Rep. of Germany

Reexamination Request:
No. 90/001,282, Jul. 7, 1987

Reexamination Certificate for:

| | |
|---|---|
| Patent No.: | **4,474,612** |
| Issued: | **Oct. 2, 1984** |
| Appl. No.: | **520,068** |
| Filed: | **Aug. 3, 1983** |

[30] Foreign Application Priority Data

Aug. 3, 1982 [DE] Fed. Rep. of Germany ..... 3228884

[51] Int. Cl.[4] ..... C25B 9/00; C25B 11/03

[52] U.S. Cl. ..... 204/252; 204/283; 204/284

[58] Field of Search ..... 204/252, 283, 284, 292

[56] References Cited

FOREIGN PATENT DOCUMENTS

| | | |
|---|---|---|
| 811238 | 1/1937 | France . |
| 1028153 | 2/1953 | France . |
| 57-164990 | 10/1982 | Japan . |
| 738433 | 11/1973 | South Africa . |

*Primary Examiner*—John F. Niebling

[57] ABSTRACT

In gas-forming electrolyzers, particularly membrane electrolyzers having vertically extending plate electrodes, each electrode plate is divided into horizontal strips and the entire active electrode surface is parallel to the counterelectrode and spaced from it as closely as possible. The top portions of each of the horizontal strips into which the electrode is divided define gas escape paths and extend away from the counterelectrode. To improve the degassing of the electrolyte the ratio of the distance G between the counterelectrode or membrane and the gas-defining line S at the lower edge of each electrode strip to the distance E between the counterelectrode or membrane and the breakaway edge K of the angled portion defining the gas escape path corresponds to a degassing capability F which is lower than 0.6.

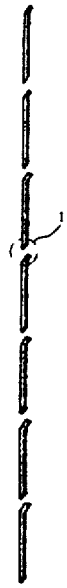

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, line 46:

In an electrode assembly of this kind the invention resides in that the ratio of the distance G between the counter-electrode or membrane and the gas-dividing line [5] *S* at the lower edge of each electrode strip to the distance E between the counterelectrode or membrane and the breakaway edge K of the angled portion defining the gas escape path corresponds to a value F (degassing capability) below 0.6.

Column 2, line 62:

When reference is made herein to the distance between the counterelectrode and the [gas-defining] *gas-dividing* line or the distance between the counter-electrode and the break-away edge, it will be understood that these distances are measured horizontally and perpendicular to the plane of the counterelectrode which is generally disposed vertically. The [gas-defining] *gas-dividing* line is the line at which gas passing upwardly is determined to pass between the plane of the electrode provided with the passages and the plane from which the distance is measured as described previously. Gas to the other side of this line is generally directed behind the electrode.

Column 3, line 19:

Of course, when a membrane is utilized, the horizontal distances measured from the [gas-defining] *gas-dividing* line and the break-away edge will be measured to the plane of the member which is proximal to the electrode formed with the passages. Thus, this membrane and the counterelectrode can be considered planar members juxtaposed with the passage-forming electrode and the distance in question is measured to the most proximal surface of the member which is most directly juxtaposed with the electrode.

Column 4, line 20:

FIG. 2 shows the detail which is designated ["A"] "*I*" in FIG. 1. In FIG. 2, M designates the membrane, [5] *S* the gas-dividing line at the lower end of the plate strip, K the breakaway edge of the angled top portion of the next lower strip, G the distance M-S and E the distance M-K.

Column 4, line 26:

In the chamfered electrode shown in FIG. 2, the gas-dividing [lines] *line* extends in the plane of the active surface 3 at the lower edge of the downwardly and forwardly extending chamfer, which in [term] *turn* lies forwardly of the downwardly and forwardly inclined [level] *bevel* 2. In electrodes which are not chamfered it is assumed that the gas-dividing line lies on the center plane of the electrode. The term "degassing capability" is used in consideration of the fact that the gas rising from the interelectrode gap will expand as far as to the [breakway] *breakaway* edge K and will then rise vertically and will be divided at the gas-dividing line into a portion which enters the interelectrode gap and a larger, second portion which in accordance with the invention flows behind the electrode.

AS A RESULT OF REEXAMINATION, IT HAS BEEN DETERMINED THAT:

Claims 1, 6, 7, 10 and 11 are determined to be patentable as amended.

Claims 2–5, 8 and 9, dependent on an amended claim, are determined to be patentable.

1. In a gas-generating electrolysis cell having a vertically oriented passage-forming electrode juxtaposed with [a planar member] *an ion-selective membrane* participating with the electrode in a gas-generating electrolysis [action] *of alkali chloride* and wherein said passages are horizontal slit-like gaps formed in said electrode, the improvement wherein in combination:

each of said gaps is defined by an upper boundary and said electrode has a forward planar surface juxtaposed with and parallel to said [member] *membrane;* a lower limb of each of said gaps is defined by a rearwardly extending portion having a break-away edge at the top thereof located rearwardly of said surface, said rearwardly extending portion having a width less than that of said surface in vertical direction, said upper boundary being defined by a downwardly and forwardly extending bevel *on the rearward surface of said electrode* terminating forwardly of said break-away edge and having a gas-dividing line separating gas rising forwardly of said surface-from gas deflected rearwardly of said electrode; and the ratio between the horizontal distance G between said gas-dividing line and said [member] *membrane* and the horizontal distance E between said break-away edge and said [member] *membrane* is less than 0.6.

6. In a gas-generating electrolysis cell having a vertical oriented passage-forming electrode juxtaposed with [a planar member] *an ion-selective membrane* participating with the electrode in a gas-generating electrolysis [action] *of alkali chloride* and wherein said passages are horizontal slit-like gaps formed in said electrode, the improvement wherein in combination:

each of said gaps is defined by an upper boundary and said electrode is a plate of a thickness of substantially 1 to 3 mm and has a forward planar surface juxtaposed with and parallel to said [member] *membrane;* a lower limb of each of said gaps is defined by a rearwardly extending portion including an angle of about 30° with said surface and having a break-away edge at the top thereof located rearwardly of said surface, said rearwardly extending portion having a width less than that of said surface in vertical direction, said upper boundary being defined by a downwardly and forwardly extending bevel *on the rearward surface of said electrode* terminating forwardly of said break-away edge and having a gas-dividing line separating gas rising forwardly of said surface from gas deflected rearwardly of said electrode, said bevel terminating at a downwardly and forwardly extending chamfer forming said gas-dividing line at said surface; and the ratio between the horizontal distance G between said gas-dividing line and said [member] *membrane* and the horizontal distance E between said break-away edge and said [member] *membrane* is less than 0.6, said gaps having widths of substantially one to ten times the thickness of said plate.

7. In a gas-generating electrolysis cell having a vertical oriented passage-forming electrode juxtaposed with [a planar member] *an ion-selective membrane* participating with the electrode in a gas-generating electrolysis [action] *of alkali chloride* and wherein said passages are horizontal slit-like gaps formed in said electrode, the improvement wherein in combination:

each of said gaps is defined by an upper boundary and said electrode is a plate of a thickness of substantially 1 to 3 mm and has a forward planar surface juxtaposed with and parallel to said [member] *membrane;* a lower limb of each of said gaps is defined by a rearwardly extending portion including an angle of about 30° with said surface and having a break-away edge at the top thereof located rearwardly of said surface, said rearwardly extending portion having a width less than that of said surface in vertical direction, said upper boundary being defined by a downwardly and forwardly extending bevel *on the rearward surface of said electrode* terminating forwardly of said break-away edge and having a gas-dividing line separating gas rising forwardly of said surface from gas deflected rearwardly of said electrode, said bevel terminating at a downwardly and forwardly extending chamfer forming said gas-dividing line at said surface; and the ratio between the horizontal distance G between said gas-dividing line and said [member] *membrane* and the horizontal distance E between said break-away edge and said [member] *membrane* is less than 0.6, said plate having a height of 5 to 50 cm.

10. In a vertically extending plate electrode for gas-forming [electrolyzers, particularly] *ion-selective* membrane electrolyzers *for electrolysis of alkali chloride*, comprising electrode plates which are divided into horizontal strips having an active electrode surface, which strips throughout their active electrode surface are parallel to a counterelectrode and have the smallest possible distance therefrom whereas the top portion of each of said strips extends away from the counterelectrode and defines a gas escape path, the improvement wherein the ratio of the distance G between the [counterelectrode or] membrane and a gas-dividing line S at a lower edge of each electrode strip to the distance E between the [counterelectrode or] membrane and a breakaway edge K of an angled portion defining *the* gas escape path corresponds to a value F of the [gassing] *degassing* capability below 0.6.

11. In an assembly for use in gas-forming [electrolyzers, particularly] *ion-selective* membrane electrolyzers *for electrolysis of alkali chloride*, comprising a vertically extending plate electrode, a counterelectrode and a membrane between the plate electrode and the counterelectrode, wherein the plate electrode is divided into horizontal strips having an active electrode surface facing the counterelectrode said strips being parallel to said counterelectrode and having the smallest possible distance therefrom throughout their active surface area and each of said stripes having a top portion which extends away from the counterelectrode and defines a gas escape path, the improvement in that the ratio of the distance G between the [counterelectrode or] membrane and a gas-dividing line S at the lower edge of each electrode strip to the distance E between the [counterelectrode or] membrane and a breakaway edge K of an angled portion defining the gas escape path corresponds to a value F of the degassing capability below 0.6.

* * * * *